United States Patent [19]

Copeland et al.

[11] Patent Number: 5,033,649

[45] Date of Patent: Jul. 23, 1991

[54] CHEMICAL SOLUTION DISPENSING AND HANDLING SYSTEM

[75] Inventors: James L. Copeland, Burnsville; Wendell D. Burch, Elko, both of Minn.

[73] Assignee: Ecolab Inc., Saint Paul, Minn.

[21] Appl. No.: 495,288

[22] Filed: Mar. 19, 1990

[51] Int. Cl.[5] ..... B67D 5/60

[52] U.S. Cl. ..... 222/132; 222/129.2; 222/145; 222/630; 137/888

[58] Field of Search ..... 222/132, 145, 185, 108, 222/395, 630, 637; 137/888, 892, 893, 895

[56] References Cited

U.S. PATENT DOCUMENTS

| | | | |
|---|---|---|---|
| 2,811,389 | 10/1957 | Fischer | 222/630 |
| 4,469,137 | 9/1984 | Cleland | 137/893 |
| 4,934,567 | 6/1990 | Vahien et al. | 222/145 |

OTHER PUBLICATIONS

Exhibit A, Economics Laboratory, Inc. Control Tower II advertising brochure No. 13554/0402/0783.

Exhibit B, Dema Engineering Company's Blend Center brochure, Bulletin No. 87003.

Exhibit C, Dema Engineering Company's Multi-Blend Center brochure Bulletin No. 89010.

Exhibit D, Dema Engineering Company's Drum--Mount Proportioner, Model 162, brochure, Bulletin No. 84002.

Exhibit E, Dema Engineering Company's Demamatic Liquid Level Proportioning Controls brochures, Bulletin No. 83009.

Exhibit F, Dema Engineering Company's New Magnetically Operated Demamatic Liquid Level Proportioning Controls brochure, Bulletin No. 87-012.

Exhibit G, Ecolab Sani-Center Installation and Operation Manual.

*Primary Examiner*—Michael S. Huppert

*Assistant Examiner*—Shari Wunsch

*Attorney, Agent, or Firm*—Merchant, Gould, Smith, Edell, Welter & Schmidt

[57] ABSTRACT

A dispensing and handling system for solutions is disclosed. The system includes a container (11) for mixing, storing and dispensing a use solution (44) through a spigot (17). The container (11) is mounted upon a cart (12), and is interconnected to a water supply conduit (16) and a concentrate solution tube (14). The concentrate solution (15) is contained within containers or bags (13). An aspirator (26) is permanently mounted within the storage container (11). The water conduit (16) and pick-up tube (14) are releasably connected to the storage container (11) by means of a quick-connect assembly (35). Also disclosed is a method for storing and handling solutions.

30 Claims, 1 Drawing Sheet

CHEMICAL SOLUTION DISPENSING AND HANDLING SYSTEM

FIELD OF THE INVENTION

The present invention relates generally to a solution dispensing system, and more particularly to a relatively portable dispensing container which combines multiple components for storing and dispensing the mixed solution.

BACKGROUND OF THE INVENTION

In janitorial settings which require a significant amount and number of specialized cleaning solutions, the liquid cleaning products are purchased on a concentrated basis, and then are diluted to the proper strength at the site where they will be used. This type of general system is employed by a wide variety of users, e.g., hotels, hospitals, restaurants, etc. Several dispensing systems have been developed for mixing and diluting the concentrated cleaning product. The dispensers usually feature at least some of the following components: a container for the concentrated cleaning product, an intermediate-sized storage container for the diluted cleaning product, a method to dose concentrate into the storage container, and a water supply line to dilute the concentrate.

The dispensing systems cover a wide range in terms of their complexity. That is, the method of dilution may be rather simple and manual in nature, but requires a great deal of operator experience. On the other hand, the dispensing system may be quite complex, requiring a mechanical device to dilute the concentrates. Such complex systems are often necessary where different cleaning products and different dilution ratios are utilized for different cleaning applications. These dispensing systems typically require several separate water lines, each water line corresponding to a different type of cleaning concentrate. From this conventional type of dispensing center, small-sized spray bottles are filled and taken to the point of usage by the janitorial personnel.

However, the cost of these conventional dispensing stations is relatively high, because of their complexity and because backflow preventors are generally required for each water connection by applicable plumbing codes, and pressure regulators are necessary to control use solution concentrations within an acceptable range. Other necessary flow control devices also add to the cost of conventional dispensing systems; for example, a pick-up probe and foot valve must be employed in order to withdraw the concentrate from a rigid container.

In addition, because of the permanent hook-up of each concentrate dispenser to its own water line and because of the size of the dispensing station, it is not possible to move the dispensing station itself close to the point of usage. This results in inconvenience for the janitorial staff, who must repeatedly return to the dispensing station in order to refill their spray bottles. It also limits the user's flexibility in substituting different types of cleaning concentrates to meet different types of requirements.

An aspirator is employed with some dispensing systems to withdraw the concentrated cleaning solution from its container. With conventional systems, each water line requires a separate aspirator, and the aspirators are located outside the storage container in a variety of places, such as mounted to the concentrate container or mounted upon the wall adjacent to the dispensing station. These locations of the aspirator add to the complexity and space requirements of the dispensing system.

Another drawback of many conventional systems is that the dilution of the concentrate is inaccurate, resulting in a cleaning product having either too high or too low of a concentration. Many systems have no way of controlling and checking the dilution, so that inaccurate mixing by the janitorial personnel often occurs. Using too much concentrated liquid cleaner is wasteful, unnecessary, and expensive. Over-use of these products also hampers thorough rinsing and leaves messy residues. On the other hand, utilization of too little cleaning concentrate in the use solution will not clean adequately.

The present invention solves these and many other problems associated with currently available dispensing systems.

SUMMARY OF THE INVENTION

The present invention is a solution storage and dispensing apparatus. The apparatus has a container with two inlet ports for two different types of liquid. The ports accommodate two inlet lines which transport the liquid into the container. The inlet lines are each removably interconnected to their respective liquid sources and container inlet ports. The container has a suitable proportioning means, such as an aspirator, permanently mounted inside of it. In the preferred embodiment, the container and the aspirator are made of a plastic material, and form a unitary piece. Preferably, one of the liquids is water, and the other liquid is a concentrated solution. The preferred apparatus features corresponding identification markings, such as color coding, on the concentrate inlet line, container, and container cap for ease of usage. The concentrate supply container is preferably made of a flexible material and is collapsible as the concentrate is withdrawn from the container.

According to another aspect of the invention, there is disclosed a method for storing and handling solutions, in which a water inlet line is interconnected to the container to provide a conduit for the water; a pick-up tube is interconnected to the container to provide a conduit for the concentrate, an aspirator being located within the container; the diluted solution is stored in the container; and an outlet in the container is opened so as to withdraw the desired amount of diluted solution.

An advantage of the present invention is that it results in cost savings for the user. Because the system is simpler in design, its cost is lower than conventional dispensers. In addition, the inventive dispensing system needs only a single water line and backflow preventor which further reduces the cost of installation. Whereas the conventional dispensing systems are quite complex and expensive, the simplicity of the present invention enables it to be low in cost and affordable for even small housekeeping and food service operations. The fact that the aspirator is self-contained within the storage container means that there is no need for an additional dispenser assembly on an adjacent wall or rack, thereby resulting in space savings. The present invention operates on water power alone, and does not require electrical connections. The various fittings, tubes, and valves are readily accessible and can be repaired easily by any necessary tightening, repair, or replacement measures.

The present invention also provides considerable flexibility by allowing the user to employ different types of cleaning products. The invention can be used for any number of chemical solutions, because the system is completely modular. The supply lines for the various concentrated cleaning products can be connected and disconnected easily, and only a single water line is needed, which is easily attachable to the appropriate storage or "product use" container. Each concentrate container and pick-up tube is easily disconnected from the storage container, and the storage container is easily disconnected from the water supply line. The modular aspect of the present invention allows the system to be appropriate for a user who employs only a single cleaning product, as well as multiple product users. With the prior art systems, the number of cleaning compositions which could be dispensed is limited to the number of water lines or the number of control valves in the dispenser. In contrast, the present invention can be utilized with an unlimited number of products.

Another advantageous feature of the present invention is that the various components of the dispensing system are color-coded to correspond with the particular cleaning product being utilized. Preferably, there are also appropriate labels on the containers which identify the name of the particular product being dispensed. This minimizes the chance of contamination and minimizes the likelihood that a particular cleaning product will be used at an improper dilution ratio, thus enhancing the effectiveness of the cleaning product. This feature also results in a cost savings for the user, in that wastage of the cleaning product is eliminated when the proper dilution ratio is maintained. According to an optional feature of the invention, each concentrate pick-up tube and water supply hose will have its own unique quick-connect mechanism with check valve so that the system is both closed and difficult to misuse.

Another advantage of the present invention's dispensing system is that it is able to deliver the cleaning and sanitation products in exact use concentrations. The metering devices contained within the dispensing system assure that the proper dilution ratio is set, thereby obviating the tendency of some janitorial personnel to over-use the product. The use concentrations can be controlled to the precise number of ounces per gallon or parts per million required. This accurate dispensing eliminates product over-use, waste and spilling.

Yet another advantage of the present invention is that it is simple, safe and easy to use. In the preferred embodiment, the user need only push a button to activate a valve and fill the product use container. The product use container is completely covered during filling, so that any splashing or splattering of the cleaning chemicals is safely contained. The invention's closed pick-up tubing and the self-containment of the aspirator within the storage container also prevent exposure to the concentrated chemicals. In addition, the present invention has a venting system to address overflow situations.

Another advantageous feature of the present invention is that it is portable enough to be set up in various locations. Because the sizes of the various components are relatively small, because only a single water line is needed, and because the system is modular, it can be set up close to the point of usage, thereby saving time and effort for the janitorial personnel. In the preferred embodiment, the apparatus is supported by a transportable cart assembly so that it is readily portable. The quick connect water assembly requires no plumbing hook-up, and can be used at any sink or faucet. With the prior art systems, a plumbing hook-up was required, which restricted the location at which the system could be utilized.

For a better understanding of the invention, and of the advantages obtained by its use, reference should be made to the drawings and accompanying descriptive matter, in which there is illustrated and described a preferred embodiment of the invention.

BRIEF DESCRIPTION OF THE DRAWINGS

In the Drawings, which form a part of the instant specification and are to be read therewith, an optimum embodiment of the invention is shown, and, in the various views, like numerals are employed to indicate like parts.

DETAILED DESCRIPTION OF THE PREFERRED EMBODIMENT

Figure 1:
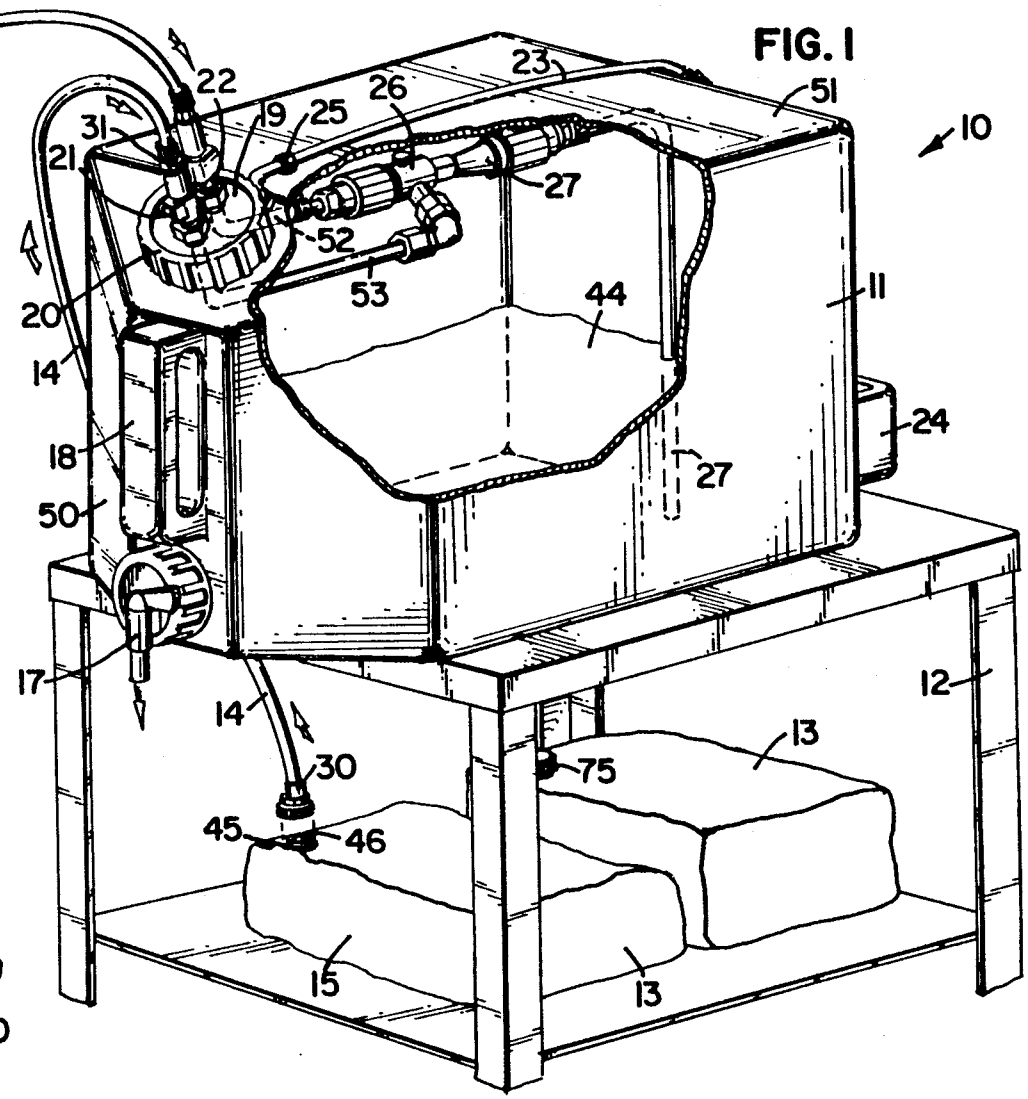
FIG. 1 is a perspective view of the dispensing and handling system of the present invention, partially exploded and partially cutaway.

Referring to FIG. 1, the system for diluting, storing and dispensing solutions is shown generally at 10. The system 10 includes a storage container or jug 11 in which the diluted cleaning product or other solution is stored before dispensing. The container 11 is preferably supported by a portable rack or cart 12. The system 10 also includes one or more containers 13 for the concentrated solution which, for example, may be concentrated cleaning products. A pick-up tube 14 transports the concentrate solution 15 into the container 11. A water supply line 16 provides a conduit for water or another type of diluent.

The water is mixed with the concentrate 15 and the diluted product is stored within the container 11. That is, the concentrated product conduit 14 and the water line 16 feed into the storage container or jug 11, so that the jug 11 contains the diluted cleaning product. The jug 11 is preferably approximately three to five gallons in size and is mounted on the rack assembly or cart 12. Each jug 11 has a spigot 17 from which the cleaning solution can be dispensed into spray bottles (not shown), such as 16 ounce or 32 ounce size. If spray bottles are not used, the cleaning solution can also be dispensed directly into mop buckets or other types of containers. The storage container 11 holds the use solution so that the spray bottles can be easily filled without the necessity of activating the water supply. The outlet or spigot 17 contains a suitable valve and control handle for activating discharge of the use solution 44. In the preferred embodiment, the diluted solution is dispensed at a rate of approximately two gallons per minute.

The front end 50 of the storage container 11 preferably includes a handle 18, which allows the storage container 11 to be easily transported when either empty or filled. This is advantageous if the janitorial personnel wish to take the storage container 11 to a point of usage. In addition, the cart 12 is preferably provided with wheels or rollers (not shown) so that the entire cart assembly may be moved as necessary after disconnection from the water supply line 16.

The storage container 11 also includes a cap assembly 19 at its front end toward the upper part of the container 11. The cap assembly 19 preferably includes a threaded, annular ring 20 which attaches to the storage container 11. A gasket (not shown) is preferably provided to prevent leakage. The cap assembly 19 has two apertures or ports 21, 22 which accommodate the two connection fittings for the inlet lines 14, 16. It is to be understood that more than two inlet ports could be provided in the cap assembly 19 or storage container 11, if it were desired that more than two inlet lines were necessary. That is, it is within the scope of the invention to fill the use container 11 with more than one concentrated solution 15. With this design, an additional orifice or port would be provided for the additional product pick-up tube, and the aspirator design would be varied as necessary.

At its upper end 51, the use container 11 is provided with a vent system 23 which diverts the chemical solution 44 away from the user in the event that the jug 11 is overfilled. The overflow solution is directed behind the storage container 11 a shown by the arrow in FIG. 1. The vent tube 23 contains a check valve 25, preferably a duckbill check valve, which opens at a pressure of approximately 1–2 psi. A suitable containment area 24 is provided for collecting any drained liquid. The containment area 24 collects any overflow solution or directs it to a suitable drain (not shown).

The internal means for proportioning the concentrate and water is illustrated by the cutaway portion of the container 11 shown in FIG. 1. Preferably, the proportioning means comprises an aspirator 26 which is built into the storage container 11. In the preferred embodiment, the storage container 11 and aspirator assembly 26 are made from a suitable plastic material such as high density polyethylene. The aspirator can be manufactured as an insert to fit within the container as illustrate in FIG. 1. Alternatively, the aspirator 26 can be mounted within the container 11 by suitable means such as spin welding or use of an adhesive, or the container assembly 11 can be blow-molded around the aspirator assembly 26.

The dispenser operates so that when a source of detergent concentrate 15 is connected to the vacuum inlet of the aspirator 26, the container 11 is filled with a diluted detergent 44. The vacuum created by the water line 16 is utilized to withdraw the proper proportion of concentrated cleaning solution 15 from its container 13. In this manner, the water and concentrate enter the container 11 simultaneously, as illustrated by the arrows in FIG. 1. Water passes through the aspirator 26, and the aspirator's output fills the product use container 11.

An alternative proportioning means other than the aspirator 26 can be utilized. For example, an electric or mechanical pump could be employed to provide the proper proportions.

Within the container 11 are a water tube 52 and a concentrate tube 53, both tubes leading into the aspirator 26. The aspirator is in fluid communication with a discharge tube 27. The discharge tube 27 extends proximate the bottom of the container 11. This allows for underwater dispensing to minimize foaming. Preferably, the walls of the container 11 are translucent or clear so that the user can see how much solution 44 is in the container 11.

The water supply line 16 is interconnected to a suitable faucet or quick-connect fitting 28. In the preferred embodiment, the water is activated by the depression of a palm button 29, which controls a water supply valve. The system is fillable at any time, so that the user need not wait until the jug 11 is empty before it can be refilled. The water supply assembly 54 contains a valve and a backflow preventor such as a siphon break system. Also provided is a flow control device to limit the water flow. These types of devices (not shown) are governed by the requirements of local plumbing codes.

In the preferred embodiment, the product concentrate 15 is contained within a collapsible, bladder type package or container 13. Preferably, the concentrate bags 13 are approximately 2.5 gallons in size. The cart 12 may be sized and configured to accommodate a plurality of concentrate packages 13. With this type of bladder bag 13, the pick-up tube 14 is simply attached to an aperture 45 in the bladder bag 13 by means of a threaded connection 46. A cap 75 is provided on the bag's opening when it is not in use. With this design, atmospheric pressure causes the concentrate packaging 13 to collapse as the concentrate 15 is withdrawn therefrom. The packages 13 are made of any flexible material which is compatible with the chemical concentrate 15, such as high density polyethylene. Alternatively, a rigid container (not shown) could be employed for supplying the concentrate 15, and the end of the pick-up tube 14 could be provided with a suitable pick-up probe and foot valve.

Examples of the types of concentrated cleaning solutions utilized with the preferred embodiment of the invention are: multi-purpose cleaners, e.g. for walls, windows, tile and hard surfaces; germicidal detergents for disinfecting and sanitizing; floor care products; and specialty products for special cleaning needs. However, it is to be understood that the present invention is not to be limited for use only with cleaning products, but can be utilized to store and dispense any type of solution.

Figure 2:
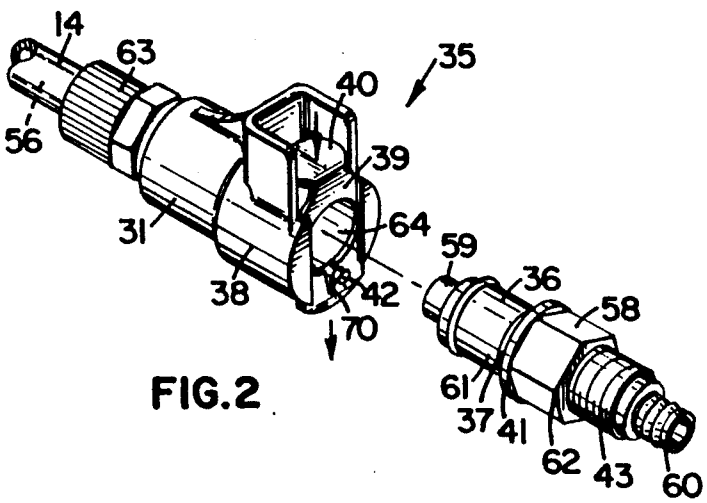
FIG. 2 is a perspective view of a preferred connection fitting utilized with the system illustrated in FIG. 1.

The blend ratio, or proportion of chemical to water, is set by flow metering means, such as interchangeable metering tips 56, shown in FIG. 2. Each metering tip 56 is sized and configured to correspond to a particular proportion ratio. The metering tips 56 are cylindrical in shape and approximately ⅜ of an inch in length, with the external diameter being slightly smaller than the internal diameter of the pickup tube 14, and the tip's internal diameter being governed by the desired flow rate. The metering tip 56 is inserted into the pick-up tube 14, and different sized orifices of the metering tips 56 allow for different flow rates of the concentrate 15. The metering tip's diameter may be as small as approximately 0.01 inch, with larger diameters corresponding to higher flow rates. The highest flow rate is achieved when no metering tip 56 at all is present in the pick-up tube 14. In the preferred embodiment, the different sized metering tips 56 correspond to different colors, so that the flow rate can be easily monitored and adjusted. This enables the user to readily determine what the dilution ratio is. Different dilution ratios are sometimes needed for different applications, e.g., one application might require a 1% solution, whereas another application may require a 10% solution of the same product. Alternatively, an adjustable metering screw may be utilized to enable the proportion ratio to be adjusted.

In the preferred embodiment, the product pick-up tube is approximately ⅜ of an inch in diameter and is less than approximately ten feet in length. These dimensions allow for adequate aspirator efficiency, and a larger tube diameter would allow for a longer pick-up tube 14 to be utilized. A minimum flow pressure of approximately 15 psi must be provided by the water source.

The pick-up tubing 14 is preferably translucent, so that the user can verify when it is filled with concentrate 15 and can view the metering tip 56. It is desirable for the pick-up tube 14 to be completely filled and not contain air. The lower end of the pick-up tube 14 has a check valve 30 in the preferred embodiment, such as an umbrella check valve.

The upper end of the pick-up tube 14 preferably also has an integrated check valve 31. In this manner, the pick-up tube 14 is completely closed by having a valve at each end. This allows the pick-up tube 14 to be disconnected without spillage of any solution.

A quick connect assembly is provided at each end of the pick-up tube to facilitate such connection and disconnection. FIG. 2 illustrates the quick-connect assembly 35 which is utilized in the preferred embodiment to interconnect the pick-up tube 14 and water supply tube 16 with the inlet ports 21, 22 in the cap assembly 19. This connection may also be utilized at the water supply assembly 54. The male member 36 is attached to the cap assembly 19 and inlet tube 52 or 53 by suitable connection means, such as by a threaded connection portion 43. The male member 36 is preferably made of plastic and includes a check valve 58. One end of the member 36 is threaded, so as to accommodate a nut (not shown in FIG. 2) for connecting the male member 36 as necessary. Each end of the male member 36 has a tubular portion 59, 60 through which the liquid flows. The male member has a small diameter portion 61 and a large diameter portion 62, the end of which defines an annular flange 41. The small diameter portion 61 has an annular groove 37 therein.

The female member 38 is interconnected to the end of the tube 14 by a suitable nut 63. The female member 38 has an aperture 64 which accommodates the small diameter portion 61 of the male member 36. A check valve 31 is integrated into the housing of the female member 38. The female member 38 has a lock ring 39 which snaps onto the male member's ring 37. A release button 40 is provided on the female member 38 to allow for disconnection of the connection 35. The button 40 and lock ring 39 are preferably made of metal and formed as a single piece. The lock ring is biased into an upper, engaged position by a spring (not shown) beneath the button 40. A spring-biased pin 42 moves between an inner and outer position. In its outer position, the enlarged pin base occupies the slot 70 in the lock ring 39. In its inner position, the narrow body of the pin (which is smaller than the slot 70) presents no resistance to the upward movement of the lock ring 39. When the members 36, 38 are brought into engagement, the annular flange portion 41 of the male member 36 pushes against the pin 42 on the female member 38 which causes upward movement of the lock ring 39 and engagement with the annular ring 37. Depression of the button 40, as shown by the arrow in FIG. 2, moves the lock ring 39 out of engagement with the ring 37. The female member 38 is provided with a spring (not shown) within its housing to allow the male member 36 to release easily upon depression of the button 40.

Another feature of the present invention is the use of identification means on the corresponding components of the system 10. Preferably, the cleaning product 15 itself, the labels on the concentrate packaging 13, and the pick-up tubing 14 are all color coded. In addition, the container cap 19, connection assemblies 35, spigot fitting 17 may also be color coded. Preferably, the spray bottles also have corresponding labels.

In the preferred embodiment, the pick-up tubing 14 has a "lock and key" connector 35 on each end. That is, the size of each container's male member 36 corresponds only to a particular concentrate having a certain sized female member 38. This system serves to minimize error and confusion, and allows the dispensing assembly to be utilized only with the concentrate provided by the supplier of the cleaning concentrate.

In operation, the user assembles the modular components by matching the colors of the use container 11, cap 19, pick-up tube 14, and concentrate container 13. The water conduit 16 is attached to the water supply 28, and the water flow preferably is initiated by activation of a palm button 29. When the jug 11 has been filled to a desired level, the pick-up tube 14 and water tube are disconnected and the use jug 11 can be moved to a remote location if desired. The diluted solution 44 is contained within the container 11 until it is dispensed via the spigot 17.

Even though numerous characteristics and advantages of the invention have been set forth in the foregoing description, together with the details of the structure and function of the invention, the disclosure is illustrative only, and changes may be made in detail, especially in matters of shape, size, and arrangement of parts, within the principles of the invention, to the full extent indicated by the broad, general meaning of the appended claims.

What is claimed is:

1. A solution storage and dispensing apparatus, comprising:

(a) a container having a first inlet port for a first liquid and a second inlet port for a second liquid, said inlet ports being in fluid communication with a proportioning means within said container, said proportioning means outletting to a discharge tube within said container;

(b) a first inlet line for supplying said first liquid, said inlet line being removably interconnected to said first inlet port and to a source of said first liquid; and (c) a second inlet line for supplying said second liquid, said inlet line being removably interconnected to said second inlet port and to a source of said second liquid.

2. The solution storage and dispensing apparatus according to claim 1, wherein said first liquid is water.

3. The solution storage and dispensing apparatus according to claim 2, wherein said proportioning means comprises an aspirator.

4. The solution storage and dispensing apparatus according to claim 2, further comprising means for venting overflow from said container.

5. The solution storage and dispensing apparatus according to claim 4, further comprising handle means.

6. The solution storage and dispensing apparatus according to claim 4, wherein said second inlet line, said container and packaging for said second liquid have corresponding identification means.

7. The solution storage and dispensing apparatus according to claim 4, wherein said second inlet line has a connection means on at least one of its ends, said connection means being sized and configured to correspond to a particular type of second liquid and a particular container.

8. The solution storage and dispensing apparatus according to claim 6, wherein said container and said aspirator are made of a plastic material.

9. The solution storage and dispensing apparatus according to claim 8, wherein said second liquid is concentrate said concentrate inlet line includes means for metering flow of the concentrate.

10. A solution storage and dispensing apparatus comprising:

(a) a storage container having a first inlet port for water, and a second inlet port for a concentrate, said inlet ports being in fluid communication with proportioning means within said container, said proportioning means being interconnected to a discharge tube within said container, said container having an outlet;

(b) a water inlet line removably interconnected to said first inlet port;

(c) a concentrate inlet line for supplying a concentrate, said concentrate inlet line being removably interconnected to said second inlet port; and (d) a concentrate container for storing the concentrate, said concentrate container being made of a collapsible material.

11. The solution storage and dispensing apparatus according to claim 10, wherein said concentrate inlet line includes means for metering flow of the concentrate.

12. The solution storage and dispensing apparatus according to claim 10, wherein said proportioning means comprises an aspirator.

13. The solution storage and dispensing apparatus according to claim 12, further comprising means for venting overflow from said container.

14. The solution storage and dispensing apparatus according to claim 12, further comprising handle means.

15. The solution storage and dispensing apparatus according to claim 11, wherein said second inlet line, said storage container, and packaging for said second liquid have corresponding identification means.

16. The solution storage and dispensing apparatus according to claim 11, wherein said second inlet line has a connection means at each end, said connection means being sized and configured to correspond to a particular type of second liquid and a particular container.

17. The solution storage and dispensing apparatus according to claim 11, wherein there are multiple concentrate containers in fluid communication with said storage container by means of multiple concentrate inlet lines.

18. A method for storing and handling liquid solutions, comprising the steps of:

(a) interconnecting a water inlet line to a use container;

(b) interconnecting a pick-up tube to said use container at one end and to a concentrate container at an opposite, second end of said pick-up tube, said use container having an aspirator therein;

(c) activating water flow into said use container and thereby withdrawing concentrate from said concentrate container via said aspirator;

(d) storing diluted solution in said use container; and (e) opening an outlet in said use container so as to withdraw diluted solution.

19. The method for storing and handling solutions according to claim 18, further comprising the step of disconnecting said pick-up tube from said use container and connecting another pick-up tube to said use container.

20. The method for storing and handling solutions according to claim 18, further comprising the step of transporting said use container proximate a point of usage.

21. The solution storage and dispensing appratus according to claim 2, wherein said proportioning means comprises an electric pump.

22. The solution storage and dispensing apparatus according to claim 2, wherein said proportioning means comprises a mechanical pump.

23. The solution storage and dispensing apparatus according to claim 10, wherein said proportioning means comprises an electric pump.

24. The solution storage and dispensing apparatus according to claim 10, wherein said proportioning means comprises a mechanical pump.

25. The solution storage and dispensing apparatus according to claim 1, wherein said first inlet line includes valve means.

26. The solution storage and dispensing apparatus according to claim 10, wherein said first inlet line includes valve means.

27. The solution storage and dispensing apparatus according to claim 1, further comprising a third inlet line for supplying a third liquid, said third inlet line being removably interconnected to a third inlet port in fluid communication with said proportioning means.

28. The solution storage and dispensing apparatus according to claim 27, further comprising a fourth inlet line for supplying a fourth liquid, said fourth inlet line being removably interconnected to a fourth inlet port in fluid communication with said proportioning means.

29. The solution storage and dispensing apparatus according to claim 10, further comprising a third inlet line for supplying a third liquid, said third inlet line being removably interconnected to a third inlet port in fluid communication with said proportioning means.

30. The solution storage and dispensing apparatus according to claim 29, further comprising a fourth inlet line for supplying a fourth liquid, said fourth inlet line being removably interconnected to a fourth inlet port in fluid communication with said proportioning means.

The Notice of Allowance was received Jan. 16, 1991; therefore, this amendment is being submitted prior to Apr. 16, 1991, the due date for the issue fee payment. Under Rule 312, the above Amendment may be entered on the recommendation of the primary examiner, approved by the Commissioner. In a March 29, 1991 teleconference with Examiner Wunsch, the Applicant was invited to submit the additional claims for her consideration.

The above claims are added to accord the Applicant more complete patent coverage for the invention. The currently-allowed claims are the twenty claims originally submitted with the patent application. The above ten claims are all dependent from the previously-allowed claims. To the extent that the above claims are dependent, and therefore narrower, than the allowed claims, it is respectfully submitted that the above ten claims should also be held allowable.

* * * * *

UNITED STATES PATENT AND TRADEMARK OFFICE

CERTIFICATE OF CORRECTION

PATENT NO. : 5,033,649

DATED : July 23, 1991

INVENTOR(S) : James L. Copeland, et al

It is certified that error appears in the above-identified patent and that said Letters Patent is hereby corrected as shown below:

In Column 5, line 18, for "a"
read:
--as--
In Column 5, line 33, for "illustrate"
read:
--illustrated--
Column 9, line 1, insert --,-- after "centrate" and before "said".
In Column 9, line 16, insert a new paragraph after "and".
In Column 10, delete lines 45-63.

Signed and Sealed this

Ninth Day of March, 1993

*Attest:*

STEPHEN G. KUNIN

*Attesting Officer*

*Acting Commissioner of Patents and Trademarks*